US011647847B2

(12) United States Patent
Fan et al.

(10) Patent No.: US 11,647,847 B2
(45) Date of Patent: May 16, 2023

(54) BABY CARRIER

(71) Applicant: WONDERLAND SWITZERLAND AG, Steinhausen (CH)

(72) Inventors: Meifeng Fan, Guangdong (CN); Mingpeng Li, Guangdong (CN)

(73) Assignee: WONDERLAND SWITZERLAND AG, Steinhausen (CH)

( * ) Notice: Subject to any disclaimer, the term of this patent is extended or adjusted under 35 U.S.C. 154(b) by 0 days.

(21) Appl. No.: 17/548,021

(22) Filed: Dec. 10, 2021

(65) Prior Publication Data

US 2022/0202202 A1 Jun. 30, 2022

(30) Foreign Application Priority Data

Dec. 4, 2020 (CN) ..... 202011420084.6

(51) Int. Cl.
*A47D 13/02* (2006.01)

(52) U.S. Cl.
CPC ..... *A47D 13/02* (2013.01); *A47D 13/025* (2013.01)

(58) Field of Classification Search
CPC ..... A47D 13/02; A47D 13/025
See application file for complete search history.

(56) References Cited

U.S. PATENT DOCUMENTS 4,234,229 A * 11/1980 Arnold ..... A47D 13/025 297/483
4,986,458 A * 1/1991 Linday ..... A47D 13/025 224/648
5,080,191 A * 1/1992 Sanchez ..... A47D 13/086 280/801.1
D409,114 S * 5/1999 Bortner ..... D11/216
6,098,859 A * 8/2000 Bortner ..... A45F 3/047 224/195
6,125,792 A * 10/2000 Gee ..... A61H 3/008 119/857
6,179,175 B1 * 1/2001 Painter ..... A45F 3/08 224/257
7,507,141 B2 * 3/2009 Ward ..... A41F 15/002 450/86
9,326,586 B2 * 5/2016 Kax ..... A45F 3/047
10,238,160 B1 * 3/2019 Mabon ..... A41C 3/0028
(Continued)

FOREIGN PATENT DOCUMENTS

CN 111904214 A 11/2020
EP 3644796 B1 * 8/2021 ..... A47D 13/025
WO 2019009744 A2 1/2019

*Primary Examiner* — Justin M Larson
(74) *Attorney, Agent, or Firm* — Hauptman Ham, LLP

(57) ABSTRACT

A baby carrier includes a carrying assembly and a support sheet. The carrying assembly includes a waist member and two shoulder straps. A front end of the waist member is connected with a lower portion of the support sheet. An upper portion of a front end of each shoulder strap is connected with an upper portion of the support sheet. A rear end of each shoulder strap is connected with a middle portion of the support sheet. A lower portion of a front end of each shoulder strap forms a circular structure connected with the waist member. A fixing member is disposed on the front end of the waist member. The lower portion of the front end of each shoulder strap is slidably connected with the fixing member. A width between the two shoulder straps is adjusted by a slide of each shoulder strap on the fixing member.

32 Claims, 10 Drawing Sheets

100

(56) References Cited

U.S. PATENT DOCUMENTS

| | | | | |
|---|---|---|---|---|
| 10,905,252 | B2 * | 2/2021 | Fan | A47D 13/025 |
| 10,905,253 | B2 * | 2/2021 | Fan | A47D 13/025 |
| 10,959,496 | B2 * | 3/2021 | Moeller | A44B 19/303 |
| 11,026,519 | B2 * | 6/2021 | Fan | A47D 13/025 |
| 11,026,520 | B2 * | 6/2021 | Fan | A47D 13/025 |
| 11,039,695 | B2 * | 6/2021 | Fan | A47D 13/025 |
| 11,297,957 | B2 * | 4/2022 | Telford | A47D 13/025 |
| 11,395,551 | B2 * | 7/2022 | Fan | A47D 13/025 |
| 11,406,201 | B2 * | 8/2022 | Fan | A47D 13/025 |
| D970,880 | S * | 11/2022 | Lou | D3/213 |
| 2022/0202202 | A1 * | 6/2022 | Fan | A47D 13/02 |
| 2022/0232996 | A1 * | 7/2022 | Fan | A47D 13/025 |

* cited by examiner

121'

BABY CARRIER

BACKGROUND OF THE INVENTION

1. Field of the Invention

The invention relates to a baby product and, more particularly, to a baby carrier capable of adjusting a width between two shoulder straps.

2. Description of the Prior Art

When a conventional forward-carrying baby carrier is used for a long time, the weight of a baby will force the baby carrier forward, thereby causing a larger load on the shoulders of a user. For users with different shoulder widths and different heights, if the baby carrier cannot adjust the position of the shoulder strap to the most suitable position for their shoulder width, the shoulder strap of the baby carrier cannot effectively and evenly distribute the load to two shoulders of the user to reduce the muscle tension or fatigue caused by using the baby carrier for a long time, thereby failing to achieve the purpose of reducing the load on the user.

SUMMARY OF THE INVENTION

An objective of the invention is to provide a baby carrier capable of being adaptively adjusted according to different shoulder widths of different users, such that the load can be evenly distributed to the shoulders of a user, so as to prevent the user from feeling fatigue too fast.

To achieve the aforesaid objective, the invention provides a baby carrier including a carrying assembly and a support sheet connected with the carrying assembly. The carrying assembly includes a waist member and two shoulder straps. A front end of the waist member is connected with a lower portion of the support sheet. An upper portion of a front end of each of the two shoulder straps is connected with an upper portion of the support sheet. A rear end of each of the two shoulder straps is connected with a middle portion of the support sheet. A lower portion of a front end of each of the two shoulder straps forms a circular structure. The circular structure is connected with the waist member. A fixing member is disposed on the front end of the waist member along a length direction. The lower portion of the front end of each of the two shoulder straps is slidably connected with the fixing member. A width between the two shoulder straps is adjusted by a slide of the front end of each of the two shoulder straps on the fixing member.

Compared to the prior art, the lower portion of the front end of each shoulder strap of the baby carrier of the invention forms a circular structure, the circular structure is slidably connected with the fixing member disposed on the front end of the waist member along the length direction, and the width between the two shoulder straps is adjusted by the slide of the circular structure of the front end of the shoulder strap on the fixing member. When the shoulder width of the user is wider, the positions of the two shoulder straps need to be adjusted to be further away from each other. At this time, the user may adjust the circular structures of the shoulder straps to slide toward opposite ends of the fixing member to adapt the baby carrier to the user with wider shoulder width. When the shoulder width of the user is narrower, the positions of the two shoulder straps need to be adjusted to be more concentrated with each other. At this time, the user may adjust the circular structures of the shoulder straps to slide toward the middle of the fixing member to adapt the baby carrier to the user with narrower shoulder width. When using the baby carrier of the invention, users can perform adaptive adjustment conveniently and quickly according to their own different shoulder widths, such that the load can be evenly distributed to the shoulders of the user and the user can keep an optimal posture of using the baby carrier, so as to prevent the user from feeling fatigue too fast.

Preferably, the circular structure is slidably sleeved on the fixing member.

Preferably, the lower portion of the front end of the shoulder strap is rolled and stitched to form the circular structure.

Preferably, the fixing member comprises a sliding member and a connecting plate fixedly connected with the front end of the waist member, and the sliding member is slidably connected with the connecting plate.

Preferably, an upper end of the sliding member forms a through hole for the circular structure to pass through.

Preferably, a lower end of the sliding member is recessed to form a sliding groove, the connecting plate has a sliding rail matched with the sliding groove, and the sliding member is slidably connected with the connecting plate by a slide of the sliding groove on the sliding rail.

Preferably, the connecting plate has a positioning hole and a lower end of the sliding member has a positioning protrusion matched with the positioning hole.

Preferably, the fixing member is a webbing structure.

Preferably, a middle segment of the fixing member is fixedly connected with a middle segment of the front end of the waist member and two circular structures of the two shoulder straps are respectively located at opposite sides of the middle segment of the fixing member.

Preferably, the middle segment of the fixing member is located at an inner side of the middle segment of the waist member. Since the fixing member is disposed at the inner side of the waist member, the middle segment of the fixing member and the circular structure are covered and hidden by the waist member, such that the appearance is simple. At the same time, when the baby carrier is used, the waist of the user is restrained by the waist member, such that the circular structure of the shoulder strap can be further stably restrained at the position of the adjusted fixing member, thereby preventing the circular structure from sliding on the fixing member due to waist-bending or body-tilt of the user. Accordingly, after the shoulder straps of the invention are adjusted, the width between the shoulder straps will not change due to the posture variation of the user.

Preferably, opposite ends of the fixing member respectively pass through opposite ends of the waist member. The slide of the circular structure is restrained between the fixed connection of the middle segments of the fixing member and the waist member and the intersection of the fixing member and the waist member, such that the circular structure will not slide excessively toward opposite ends of the fixing member, so as to prevent the shoulder strap from slipping off.

Preferably, the opposite ends of the fixing member respectively and slidably pass through the opposite ends of the waist member. Since the opposite ends of the fixing member respectively and slidably pass through the opposite ends of the waist member, the waist member and the fixing member will cross each other. When the fixing member is located at the inner side of the waist member, the middle segment of the fixing member and the circular structure of the shoulder strap are covered and hidden by the waist member. When the baby carrier is used, the waist member needs to be tightly tied to the waist of the user, such that the position of the circular structure after width adjustment is stably compressed and positioned between the waist member and the abdomen of the user, so as to prevent the adjusted shoulder strap from sliding during use.

Preferably, the opposite ends of the fixing member respectively pass through the opposite ends of the waist member and a portion of the fixing member passing through the waist member is fixedly stitched. Since the opposite ends of the fixing member respectively pass through the opposite ends of the waist member, the circular structure can be assembled on the fixing member conveniently. Since the portion of the fixing member passing through the waist member is fixedly stitched, the invention can improve the firmness and stability of the fixing member, prevent the fixing member from deforming, and ensure that the circular structure slides smoothly on the fixing member, thereby enabling the shoulder strap to be adjusted smoothly and conveniently.

Preferably, the opposite ends of the fixing member are detachably connected with each other by a first fastener in an engagement manner and a length of the first fastener is adjustable.

Preferably, the circular structure is detachably connected with the waist member.

Preferably, the circular structure is detachably connected with the waist member by one of Velcro, buckle and snap button.

Preferably, the two shoulder straps are arranged in parallel.

Preferably, the two shoulder straps are detachably connected with each other by a plug-in buckle in an engagement manner and a length of the plug-in buckle is adjustable.

Preferably, the two shoulder straps are arranged in a cross manner. The cross arrangement not only well distributes the load from the shoulders to the back of the user, but also effectively prevents the shoulder straps from slipping off. Accordingly, the invention improves the stability and firmness of the forward-carrying baby carrier and ensures that the baby is kept at a more stable position, thereby ensuring the safety of the baby.

Preferably, the baby carrier further comprises a shoulder strap fixing member, the two shoulder straps slidably pass through the shoulder strap fixing member in the cross manner, the two shoulder straps are arranged in the cross manner by the shoulder strap fixing member, a cross position between the two shoulder straps are adjusted by a slide of the shoulder strap fixing member. The users with different shoulder widths and different heights can perform adaptive adjustment for the cross position between the two shoulder straps according to their own practical conditions, such that the cross position between the two shoulder straps can be adjusted and fixed at a load-bearing position suitable for the their own conditions. Consequently, the load can be evenly distributed to the shoulder, back and waist of the user to reduce the load on the shoulder of the user and prevent the user from feeling fatigue too fast.

Preferably, the shoulder strap fixing member has two channels crossing each other for the two shoulder straps to slidably pass through, and the two shoulder straps correspondingly pass through the two channels in the cross manner.

Preferably, the shoulder strap fixing member is a hollow structure, the shoulder strap fixing member has a plurality of ports penetrating through the hollow structure on two cross directions, and two of the ports opposite to each other allow the same shoulder strap to pass through.

Preferably, the shoulder strap fixing member is a diamond structure.

Preferably, the shoulder strap fixing member is a ring-shaped structure.

Preferably, the ring-shaped structure is divided into four ports and each of the ports forms a skidproof hook extending inward. The skidproof hook prevents the two shoulder straps from sliding with respect to each other on the shoulder strap fixing member and further fixes the cross position between the two shoulder straps, so as to improve the stability of the baby carrier.

Preferably, a cross angle formed between the two shoulder straps at the ring-shaped structure is 90°. Accordingly, when the baby carrier is used, the two shoulder straps will be closer to the shoulder blades, so as to reduce the concentration of force and enable the user to feel comfort.

Preferably, the upper portion of the support sheet and the upper portions of the front ends of the two shoulder straps are detachable structures.

Preferably, the upper portion of the front end of the shoulder strap is detachably connected with the upper portion of the support sheet by a second fastener in an engagement manner and a length of the second fastener is adjustable. By means of the second fastener, the user can conveniently and quickly detach the upper portion of the support sheet from the upper portions of the front ends of the two shoulder straps. The user only needs to hold the baby in front of the body, wraps the baby with the support sheet, and then closes the second fastener. The whole operation of carrying the baby can be completed by a single person.

Preferably, the shoulder strap is a length-adjustable structure. The users with different shoulder widths and different heights can perform adaptive adjustment for the length of the shoulder strap according to their own practical conditions, so as to achieve an optimal posture.

Preferably, the rear end of the shoulder strap is detachably connected with the middle portion of the support sheet by a third fastener in an engagement manner and a length of the third fastener is adjustable.

Preferably, the rear end of the shoulder strap is fixedly connected with the middle portion of the support sheet.

Preferably, the rear end of the shoulder strap is a webbing structure, the middle portion of the support sheet is connected with another webbing structure, the webbing structure of the rear end of the shoulder strap is fixedly connected with the another webbing structure of the middle portion of the support sheet by a buckle.

Preferably, the shoulder strap has a wing portion extending outward and the wing portion has an expanding position and a folding position with respect to the shoulder strap. When the wing portion is located at the expanding position, the contact area between the shoulder strap and the shoulder of the user increases, so as to reduce the concentration of force and improve the comfort of use. When the wing portion is located at the folding position, the wing portion is folded inward and stored between the shoulder strap and the shoulder of the user, so as to keep the appearance simple and beautiful.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
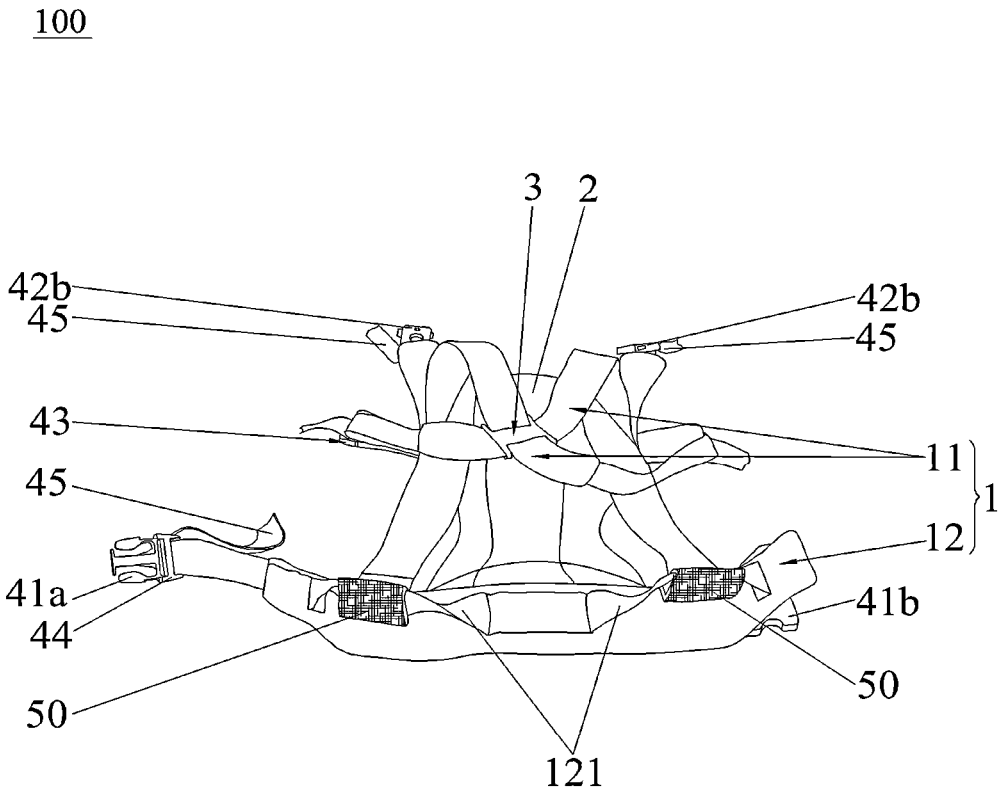
FIG. 1 is a schematic rear view illustrating a baby carrier of the invention in an expanded state.

In order to explain the disclosure and structural features in detail, the invention will be further described with the embodiments and drawings in the following.

As shown in FIGS. 1 to 5, a baby carrier 100 of the invention comprises a carrying assembly 1 capable of being worn by a user 101 and a support sheet 2 connected with the carrying assembly 1 for carrying a baby. In general, the support sheet 2 may be made of flexible materials, such as fabrics, especially breathable fabrics, skin-friendly fabrics, etc., so as to enhance the comfort of the baby. The carrying assembly 1 comprises a waist member 12 configured to be tied to the waist of the user 101 and two shoulder straps 11 configured to be tied to the shoulders of the user 101. It should be noted that the "front end" mentioned in the invention refers to the front side of the user 101, and the "rear end" mentioned in the invention refers to the back side of the user 101. A front end of the waist member 12 is connected with a lower portion of the support sheet 2. An upper portion of a front end of each of the two shoulder straps 11 is connected with an upper portion of the support sheet 2. A rear end of each of the two shoulder straps 11 is connected with a middle portion of the support sheet 2. A lower portion of a front end of each of the two shoulder straps 11 forms a circular structure 111. The circular structure 111 is connected with the waist member 12. Specifically, a fixing member 121 is disposed on the front end of the waist member 12 along a length direction, the lower portion of the front end of each of the two shoulder straps 11 is slidably connected with the fixing member 121, and a width between the two shoulder straps 11 is adjusted by a slide of the front end of each of the two shoulder straps 11 on the fixing member 121. Specifically, the lower portion of the front end of the shoulder strap 11 forms the circular structure 111, the circular structure 111 is slidably sleeved on the fixing member 121, and the lower portion of the front end of the shoulder strap 11 is rolled and stitched to form the circular structure 111. Specifically, the circular structure 111 is detachably connected with the waist member 12. More specifically, the circular structure 111 is detachably connected with the waist member 12 by Velcro 50. Needless to say, the circular structure 111 may also be detachably connected with the waist member 12 by buckle, snap button or the like, and the invention is not so limited. In the first embodiment, the fixing member 121 is a webbing structure. Specifically, a middle segment of the fixing member 121 is fixedly connected with a middle segment of the front end of the waist member 12 and two circular structures 111 are respectively located at opposite sides of the middle segment of the fixing member 121. More specifically, the middle segment of the fixing member 121 is located at an inner side of the middle segment of the waist member 12. Since the fixing member 121 is disposed at the inner side of the waist member 12, the middle segment of the fixing member 121 and the circular structure 111 are covered and hidden by the waist member 12, such that the appearance is simple. At the same time, when the baby carrier 100 is used, the waist of the user is restrained by the waist member 12, such that the circular structure 111 of the shoulder strap 11 can be further stably restrained at the position of the adjusted fixing member 121, thereby preventing the circular structure 111 from sliding on the fixing member 121 due to waist-bending or body-tilt of the user 101. Accordingly, after the shoulder straps 11 of the invention are adjusted, the width between the shoulder straps 11 will not change due to the posture variation of the user 101. Specifically, opposite ends of the fixing member 121 respectively pass through opposite ends of the waist member 12. More specifically, the opposite ends of the fixing member 121 respectively and slidably pass through the opposite ends of the waist member 12. The slide of the circular structure 111 is restrained between the fixed connection of the middle segments of the fixing member 121 and the waist member 12 and the intersection of the fixing member 121 and the waist member 12, such that the circular structure 111 will not slide excessively toward opposite ends of the fixing member 121, so as to prevent the shoulder strap 11 from slipping off. Furthermore, since the opposite ends of the fixing member 121 respectively and slidably pass through the opposite ends of the waist member 12, the waist member 12 and the fixing member 121 will cross each other. When the fixing member 121 is located at the inner side of the waist member 12, the middle segment of the fixing member 121 and the circular structure 111 of the shoulder strap 11 are covered and hidden by the waist member 12. When the baby carrier 100 is used, the waist member 12 needs to be tightly tied to the waist of the user 101, such that the position of the circular structure 111 after width adjustment is stably compressed and positioned between the waist member 12 and the abdomen of the user 101, so as to prevent the adjusted shoulder strap 11 from sliding during use. More specifically, after the opposite ends of the fixing member 121 respectively pass through the opposite ends of the waist member 12, a portion of the fixing member 121 passing through the waist member 12 is fixedly stitched. Since the opposite ends of the fixing member 121 respectively pass through the opposite ends of the waist member 12, the circular structure 111 can be assembled on the fixing member 121 conveniently. Since the portion of the fixing member 121 passing through the waist member 12 is fixedly stitched, the invention can improve the firmness and stability of the fixing member 121, prevent the fixing member 121 from deforming, and ensure that the circular structure 111 slides smoothly on the fixing member 121, thereby enabling the shoulder strap 11 to be adjusted smoothly and conveniently. More specifically, the opposite ends of the fixing member 121 are detachably connected with each other by a first fastener 41 in an engagement manner and a length of the first fastener 41 is adjustable. Specifically, the first fastener 41 comprises a male buckle 41*a* and a female buckle 41*b* engaged with the male buckle 41*a*. The opposite ends of the fixing member 121 are respectively connected with the male buckle 41*a* and the female buckle 41*b*. There is a buckle 44 connected with the bottom of the male buckle 41*a* (the buckle 44 is a common buckle for adjusting a length of a webbing). The opposite ends of the fixing member 121 may be detachably connected with each other by the engagement between the male buckle 41*a* and the female buckle 41*b*. Preferably, the buckle 44 may be connected with a webbing structure 45, such that a connecting length of the fixing member 121 may be adjusted by a slide of the buckle 44 on the webbing 45.

Figure 2:
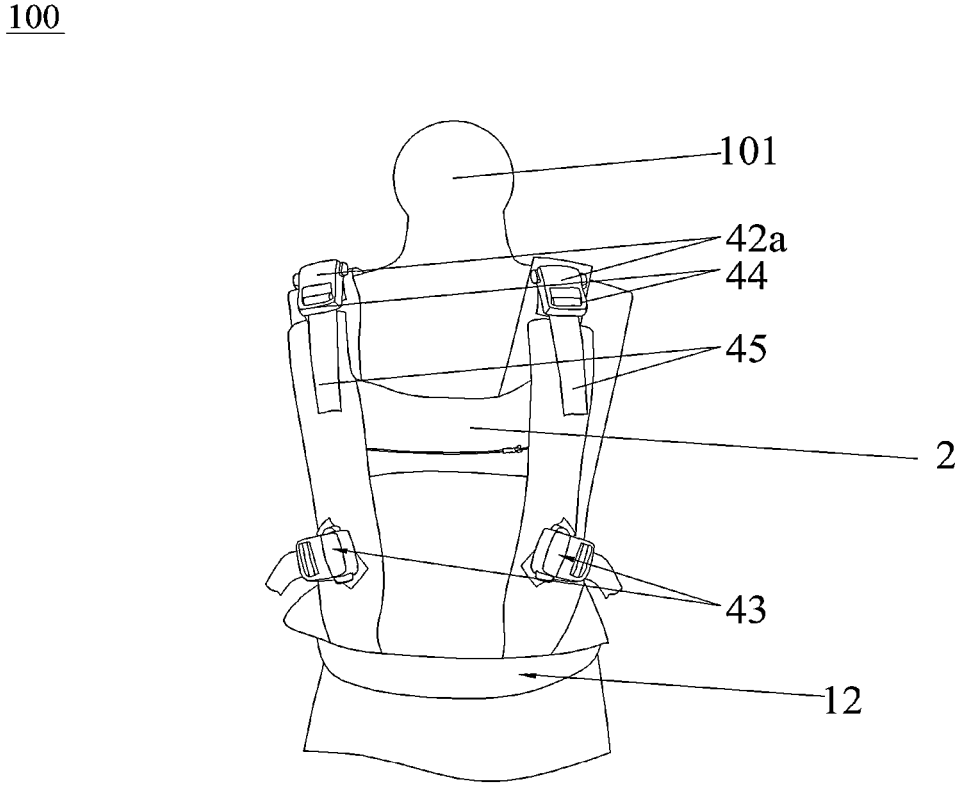
FIG. 2 is a schematic front view illustrating the structure of the baby carrier of the invention worn by a user.

As shown in FIG. 2, the upper portion of the support sheet 2 and the upper portions of the front ends of the two shoulder straps 11 are detachable structures. More specifically, the upper portion of the front end of the shoulder strap 11 is detachably connected with the upper portion of the support sheet 2 by a second fastener 42 in an engagement manner and a length of the second fastener 42 is adjustable. The second fastener 42 comprises a male buckle 42*a* and a female buckle 42*b* engaged with the male buckle 42*a*. Opposite ends of the upper portion of the support sheet 2 are respectively connected with the male buckle 42*a*. There is a buckle 44 connected with the bottom of the male buckle 42*a*. The female buckle 42*b* engaged with the male buckle 42*a* is fixed on the upper portion of the front end of the shoulder strap 11. The upper portion of the support sheet 2 may be detachably connected with the upper portions of the front ends of the two shoulder straps 11 by the engagement between the male buckle 42*a* and the female buckle 42*b*. Preferably, a connecting length between the upper portion of the support sheet 2 and the upper portion of the front end of the shoulder strap 11 may be adjusted by a slide of the buckle 44 on the webbing 45. By means of the second fastener 42, the user 101 can conveniently and quickly detach the upper portion of the support sheet 2 from the upper portions of the front ends of the two shoulder straps 11. The user 101 only needs to hold the baby in front of the body, wraps the baby with the support sheet 2, and then closes the second fastener 42. The whole operation of carrying the baby can be completed by a single person. Specifically, in the first embodiment, the rear end of the shoulder strap 11 is detachably connected with the middle portion of the support sheet 2 by a third fastener 43 in an engagement manner and a length of the third fastener 43 is adjustable. The third fastener 43 comprises a male buckle 43*a* and a female buckle 43*b* engaged with the male buckle 43*a*. The rear end of each shoulder strap 11 is connected with the male buckle 43*a* by a buckle 44. A length of the shoulder strap 11 is adjusted by a slide of the buckle 44 on the webbing structure 45. The female buckle 43*b* engaged with the male buckle 43*a* is fixed at opposite sides of the middle portion of the support sheet 2. The rear end of the shoulder strap 11 may be detachably connected with the middle portion of the support sheet 2 by the engagement between the male buckle 43*a* and the female buckle 43*b*.

Figure 3:
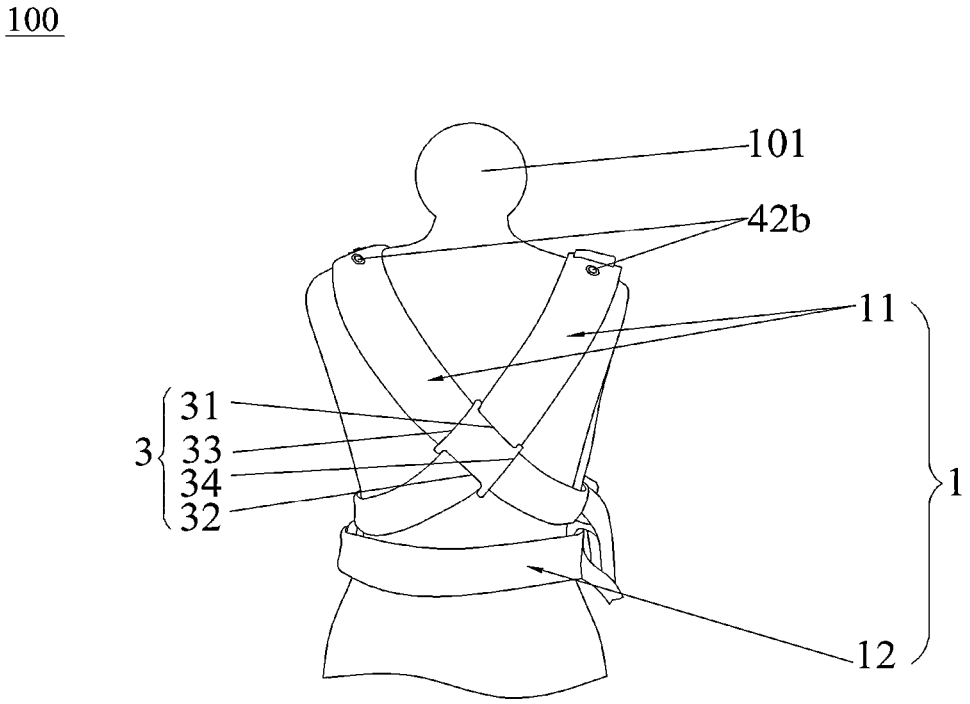
FIG. 3 is a schematic rear view illustrating the structure of the baby carrier of the invention worn by the user.

As shown in FIG. 3, the two shoulder straps 11 are arranged in a cross manner at a back of the user 101. The cross arrangement not only well distributes the load from the shoulders to the back of the user 101, but also effectively prevents the shoulder straps 11 from slipping off. Accordingly, the invention improves the stability and firmness of the forward-carrying baby carrier and ensures that the baby is kept at a more stable position, thereby ensuring the safety of the baby. More specifically, the baby carrier 100 further comprises a shoulder strap fixing member 3. The shoulder strap fixing member 3 of the first embodiment is a diamond structure. The two shoulder straps 11 slidably pass through the shoulder strap fixing member 3 in the cross manner. The two shoulder straps 11 are arranged in the cross manner at the back of the user 101 by the shoulder strap fixing member 3. A cross position between the two shoulder straps 11 are adjusted by a slide of the shoulder strap fixing member 3. The users 101 with different shoulder widths and different heights can perform adaptive adjustment for the cross position between the two shoulder straps 11 according to their own practical conditions, such that the cross position between the two shoulder straps 11 can be adjusted and fixed at a load-bearing position suitable for the their own conditions. Consequently, the load can be evenly distributed to the shoulder, back and waist of the user 101 to reduce the load on the shoulder of the user 101 and prevent the user 101 from feeling fatigue too fast. More specifically, the shoulder strap fixing member 3 has two channels crossing each other for the two shoulder straps 11 to slidably pass through, and the two shoulder straps 11 correspondingly pass through the two channels in the cross manner. More specifically, the shoulder strap fixing member 3 is a hollow structure. The shoulder strap fixing member 3 has four ports penetrating through the hollow structure on two cross directions. The four ports consist of a first port 31, a second port 32, a third port 33 and a fourth port 34, wherein the first port 31 is opposite to the second port 32, the third port 33 is opposite to the fourth port 34, and two of the ports opposite to each other allow the same shoulder strap 11 to pass through.

Specifically, the shoulder strap 11 is a length-adjustable structure. The users 101 with different shoulder widths and different heights can perform adaptive adjustment for the length of the shoulder strap 11 according to their own practical conditions, so as to achieve an optimal posture. In another embodiment (not shown), the two shoulder straps 11 may be further arranged in parallel at the back of the user 101. More specifically, the two shoulder straps 11 are detachably connected with each other by a plug-in buckle in an engagement manner and a length of the plug-in buckle is adjustable. However, the detachable connection between the two shoulder straps 11 is not limited to the aforesaid manner.

Figure 4:
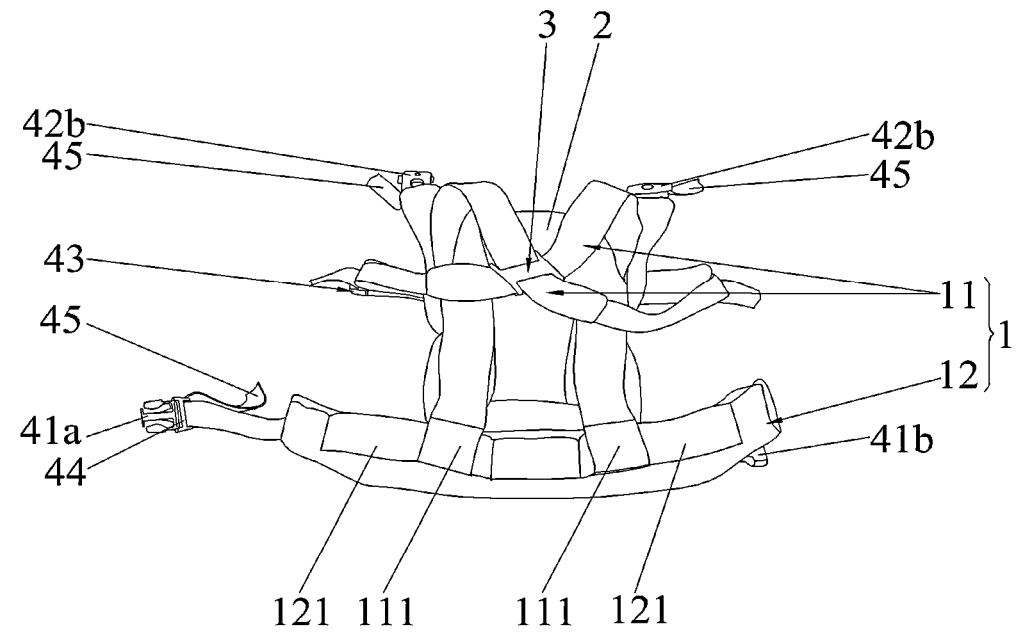
FIG. 4 is a schematic view illustrating two shoulder straps of the baby carrier of the invention located at first positions.
Figure 5:
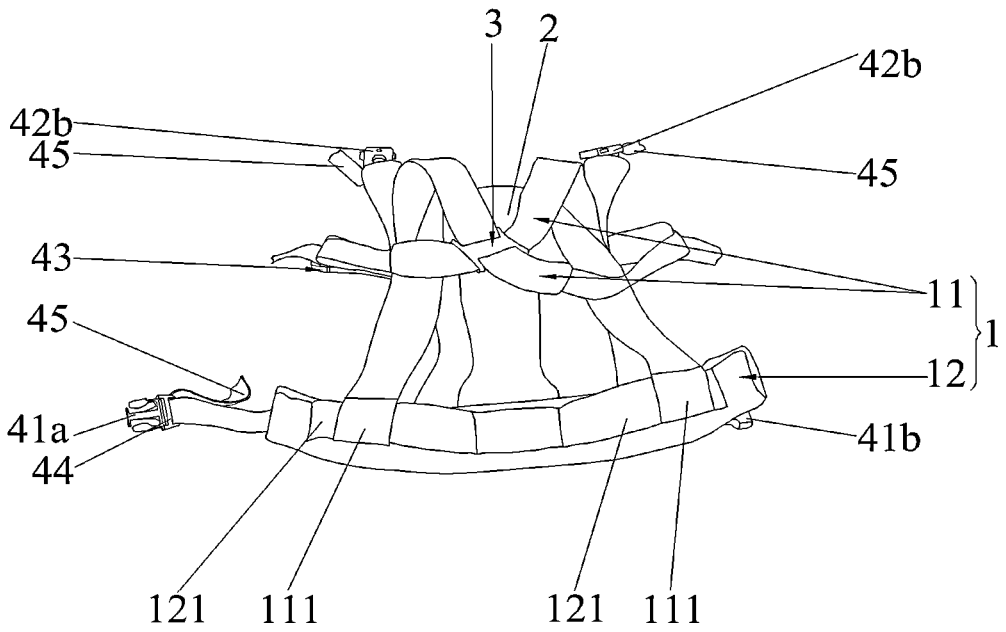
FIG. 5 is a schematic view illustrating the two shoulder straps of the baby carrier of the invention located at second positions.
Figure 6:
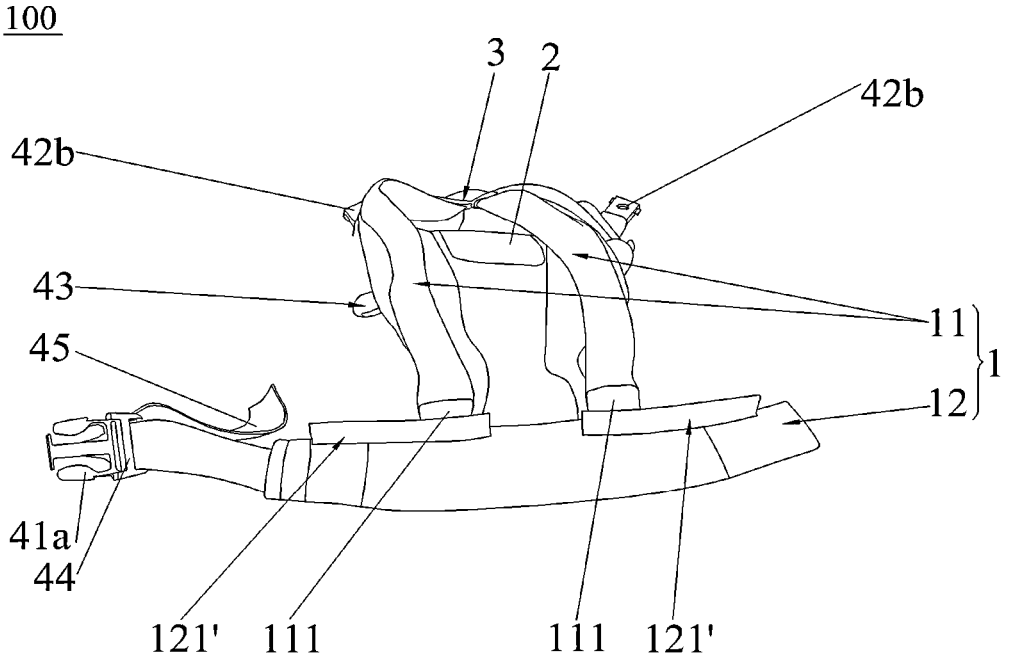
FIG. 6 is a schematic view illustrating a shoulder strap of a baby carrier of a second embodiment of the invention located at first positions.
Figure 7:
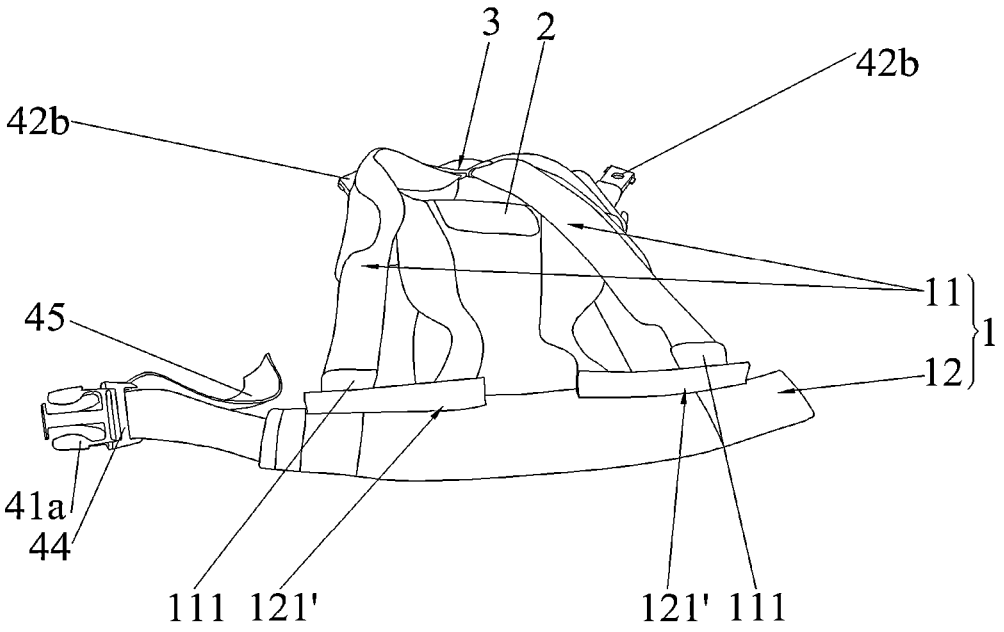
FIG. 7 is a schematic view illustrating the shoulder strap of the baby carrier of the second embodiment of the invention located at second positions.
Figure 8:
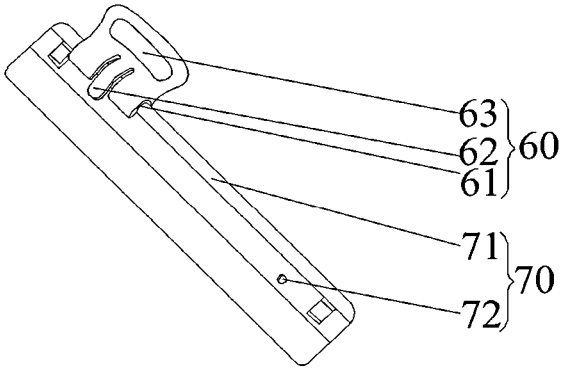
FIG. 8 is a schematic assembly view illustrating the structure of a fixing member of the second embodiment of the invention.
Figure 9:
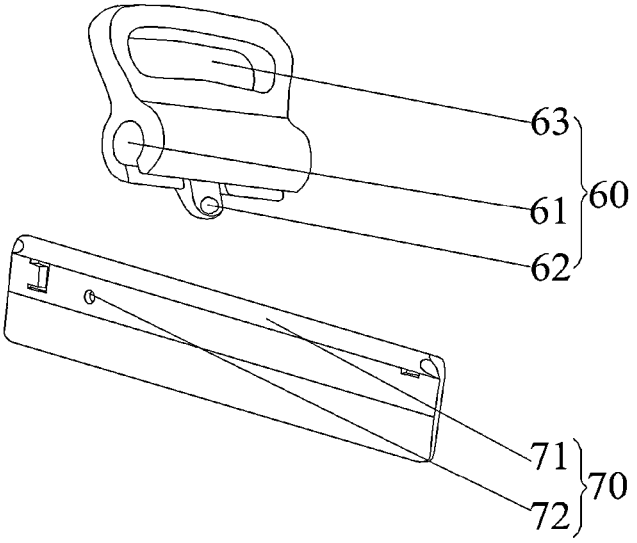
FIG. 9 is a schematic exploded view illustrating the structure of the fixing member of the second embodiment of the invention.

As shown in FIGS. 4 and 5, when the baby carrier 100 is used, the circular structure 111 needs to be adjusted to a position suitable for the shoulder width of the user 101. When the shoulder width of the user 101 is narrower, the positions of the two shoulder straps 11 need to be adjusted to be more concentrated with each other. At this time, the user may adjust the circular structures 111 of the shoulder straps 11 to slide toward the middle of the fixing member 121, such that the shoulder straps 11 are located at first positions shown in FIG. 4, so as to adapt the baby carrier 100 to the user 101 with narrower shoulder width. When the shoulder width of the user 100 is wider, the positions of the two shoulder straps 11 need to be adjusted to be further away from each other. At this time, the user 101 may adjust the circular structures 111 of the shoulder straps 11 to slide toward opposite ends of the fixing member 121, such that the shoulder straps 11 are located at second positions shown in FIG. 5, so as to adapt the baby carrier 100 to the user 101 with wider shoulder width. After adjusting the shoulder straps 11 to the suitable positions, the circular structures 111 are fixedly connected with the waist member 12 by Velcro 50 and the waist member 12 is tied to the waist of the user 101, such that the position of the circular structure 111 after width adjustment is stably compressed and positioned between the waist member 12 and the abdomen of the user 101. Then, the opposite ends of the fixing member 121 are engaged with each other by the first fastener 41. Then, the user 101 holds the baby in front of the body and wraps the baby with the support sheet 2. Then, the upper portions of the front ends of the shoulder straps 11 are engaged with the upper portion of the support sheet 2 by the second fastener 42, and the rear ends of the shoulder straps 11 are engaged with the middle portion of the support sheet 2 by the third fastener 43. Consequently, the whole operation of carrying the baby can be completed by a single person.

As shown in FIGS. 6 to 9, the fixing member 121' of the second embodiment comprises a sliding member 60 and a connecting plate 70 fixedly connected with the front end of the waist member 12, and the sliding member 60 is slidably connected with the connecting plate 70. An upper end of the sliding member 60 forms a through hole 63 for the circular structure 111 to pass through. A lower end of the sliding member 60 is recessed to form a sliding groove 61. The connecting plate 70 has a sliding rail 71 matched with the sliding groove 61. The sliding member 60 is slidably connected with the connecting plate 70 by a slide of the sliding groove 61 on the sliding rail 71. The connecting plate 70 has a positioning hole 72 and a lower end of the sliding member 60 has a positioning protrusion 62 matched with the positioning hole 72.

Figure 10:
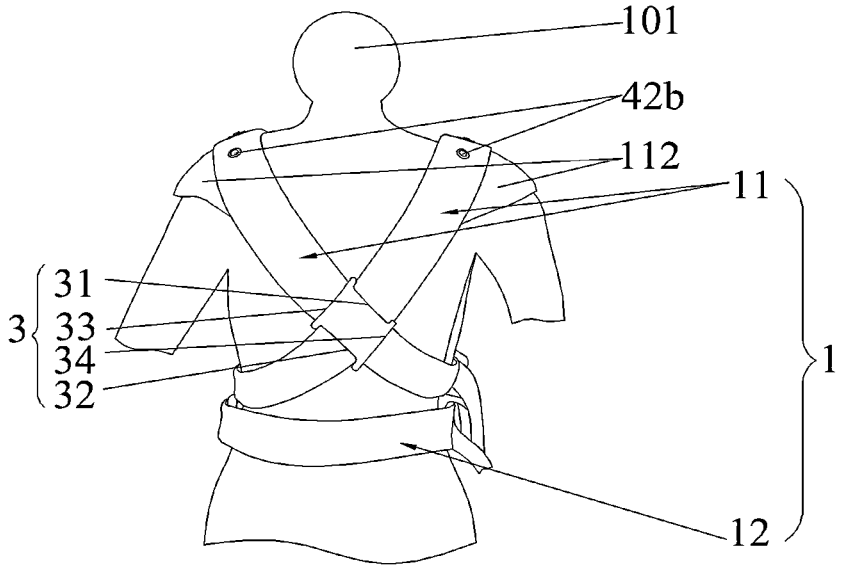
FIG. 10 is a schematic rear view illustrating the structure of a shoulder strap of the baby carrier of the second embodiment of the invention.
Figure 11:
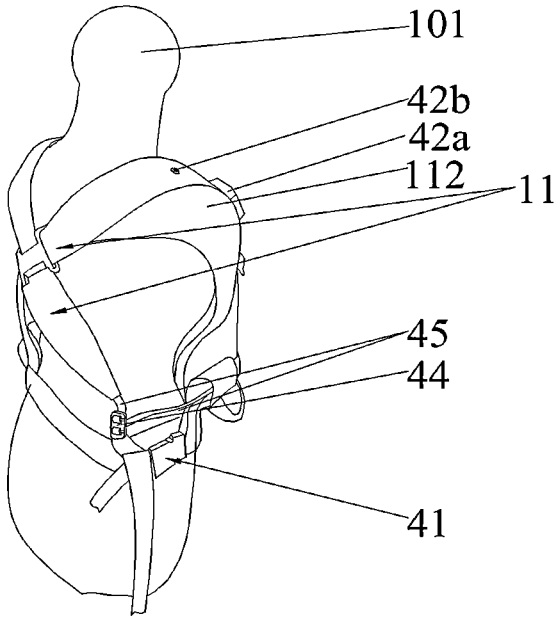
FIG. 11 is a schematic side view illustrating the structure of the shoulder strap of the baby carrier of the second embodiment of the invention.

As shown in FIGS. 10 and 11, in the second embodiment, the rear end of the shoulder strap 11 is fixedly connected with the middle portion of the support sheet 2. More specifically, the rear end of the shoulder strap 11 is a webbing structure 45, the middle portion of the support sheet 2 is connected with another webbing structure 45, the webbing structure 45 of the rear end of the shoulder strap 11 is fixedly connected with the another webbing structure 45 of the middle portion of the support sheet 2 by a buckle 44. Specifically, the shoulder strap 11 has a wing portion 112 extending outward and corresponding to a shoulder of the user 101. The wing portion 112 has an expanding position and a folding position with respect to the shoulder strap 11. When the wing portion 112 is located at the expanding position, the contact area between the shoulder strap 11 and the shoulder of the user 101 increases, so as to reduce the concentration of force and improve the comfort of use. When the wing portion 112 is located at the folding position, the wing portion 112 is folded inward and stored between the shoulder strap 11 and the shoulder of the user 101, so as to keep the appearance simple and beautiful.

Figure 12:
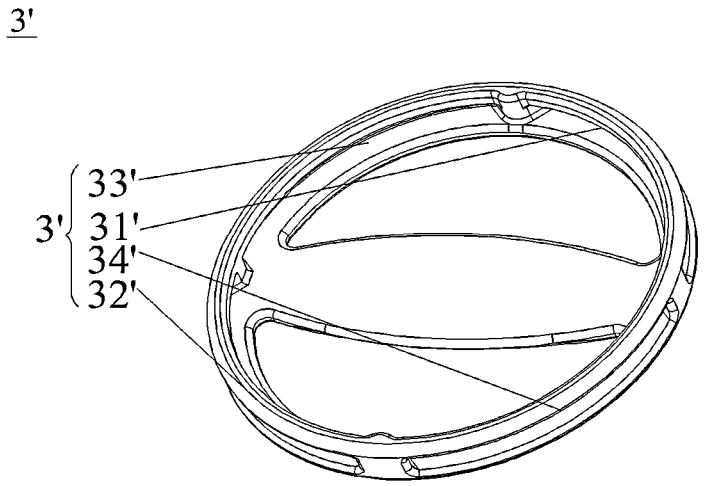
FIG. 12 is a schematic perspective view illustrating the structure of a shoulder strap fixing member of the second embodiment of the invention.
Figure 13:
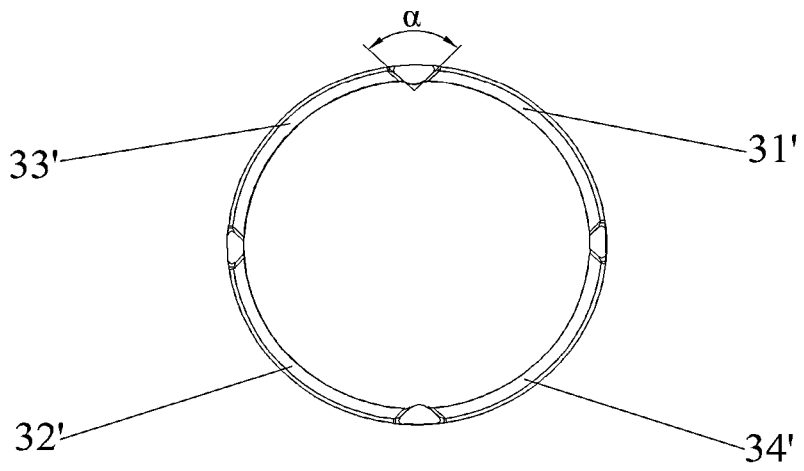
FIG. 13 is a schematic sectional view illustrating the structure of the shoulder strap fixing member of the second embodiment of the invention.
Figure 14:
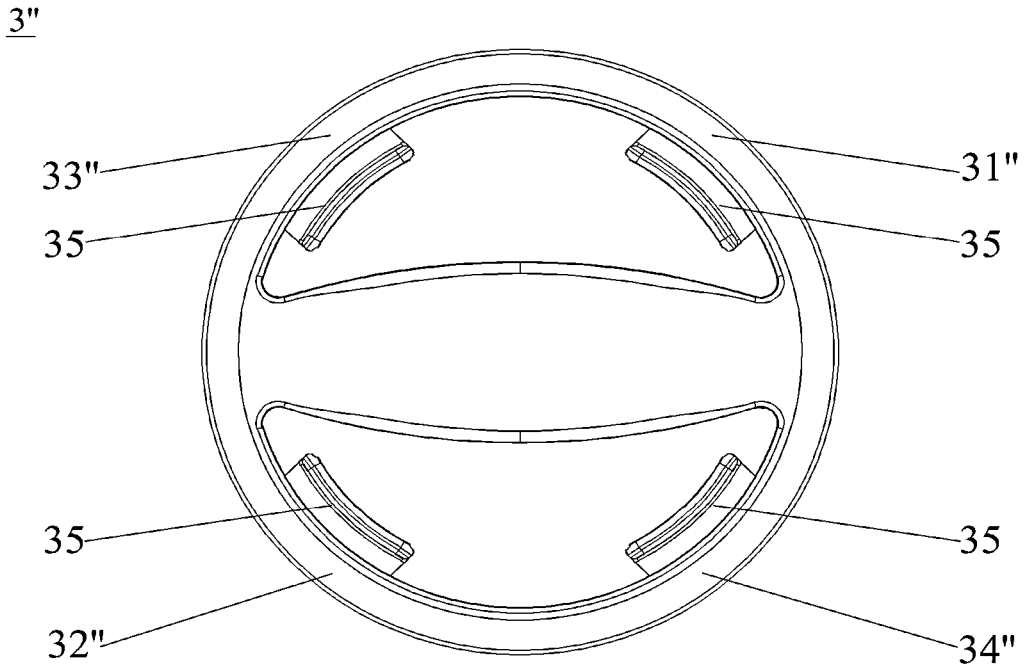
FIG. 14 is a schematic view illustrating the structure of a shoulder strap fixing member of a third embodiment of the invention.

As shown in FIGS. 12 and 13, the shoulder strap fixing member 3' of the second embodiment is a ring-shaped structure. The ring-shaped structure is divided into four ports consisting of a first port 31', a second port 32', a third port 33' and a fourth port 34', wherein the first port 31' is opposite to the second port 32', the third port 33' is opposite to the fourth port 34', and two of the ports opposite to each other allow the same shoulder strap 11 to pass through. As shown in FIG. 14, each of the ports of the shoulder strap fixing member 3" of the third embodiment forms a skidproof hook 35 extending inward. The skidproof hook 35 prevents the two shoulder straps 11 from sliding with respect to each other on the shoulder strap fixing member 3" and further fixes the cross position between the two shoulder straps 11, so as to improve the stability of the baby carrier 100. Specifically, a cross angle $\alpha$ formed between the two shoulder straps 11 at the ring-shaped structure is 90°. Accordingly, when the baby carrier 100 is used, the two shoulder straps 11 will be closer to the shoulder blades, so as to reduce the concentration of force and enable the user 101 to feel comfort.

As shown in FIGS. 1 to 14, compared to the prior art, the lower portion of the front end of each shoulder strap 11 of the baby carrier 100 of the invention forms a circular structure 111, the circular structure 111 is slidably connected with the fixing member 121 disposed on the front end of the waist member 12 along the length direction, and the width between the two shoulder straps 11 is adjusted by the slide of the circular structure 111 of the front end of the shoulder strap 11 on the fixing member 121. When the shoulder width of the user 101 is wider, the positions of the two shoulder straps 11 need to be adjusted to be further away from each other. At this time, the user 101 may adjust the circular structures 111 of the shoulder straps 11 to slide toward opposite ends of the fixing member 121 to adapt the baby carrier 100 to the user with wider shoulder width. When the shoulder width of the user 101 is narrower, the positions of the two shoulder straps 11 need to be adjusted to be more concentrated with each other. At this time, the user 101 may adjust the circular structures 111 of the shoulder straps 11 to slide toward the middle of the fixing member 121 to adapt the baby carrier 100 to the user 101 with narrower shoulder width. When using the baby carrier 100 of the invention, users can perform adaptive adjustment conveniently and quickly according to their own different shoulder widths, such that the load can be evenly distributed to the shoulders of the user 101 and the user 101 can keep an optimal posture of using the baby carrier 100, so as to prevent the user 101 from feeling fatigue too fast. At the same time, the slide of the circular structure 111 is restrained between the fixed connection of the middle segments of the fixing member 121 and the waist member 12 and the intersection of the fixing member 121 and the waist member 12, such that the circular structure 111 will not slide excessively toward opposite ends of the fixing member 121, so as to prevent the shoulder strap 11 from slipping off. Furthermore, since the opposite ends of the fixing member 121 respectively and slidably pass through the opposite ends of the waist member 12, the waist member 12 and the fixing member 121 will cross each other. When the fixing member 121 is located at the inner side of the waist member 12, the middle segment of the fixing member 121 and the circular structure 111 of the shoulder strap 11 are covered and hidden by the waist member 12. When the baby carrier 100 is used, the waist member 12 needs to be tightly tied to the waist of the user 101, such that the position of the circular structure 111 after width adjustment is stably compressed and positioned between the waist member 12 and the abdomen of the user 101, so as to prevent the adjusted shoulder strap 11 from sliding during use. The position of the shoulder strap 11 of the baby carrier 100 of the invention can be adjusted conveniently and quickly, the operation is easy, and the baby carrier 100 of the invention is suitable for the users with different shoulder widths. The baby carrier 100 of the invention is more flexible in use and suitable for widespread use.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A baby carrier comprising a carrying assembly and a support sheet connected with the carrying assembly, the carrying assembly comprising a waist member and two shoulder straps, a front end of the waist member being connected with a lower portion of the support sheet, an upper portion of a front end of each of the two shoulder straps being connected with an upper portion of the support sheet, a rear end of each of the two shoulder straps being connected with a middle portion of the support sheet, a lower portion of a front end of each of the two shoulder straps forming a circular structure, the circular structure being connected with the waist member, a fixing member being disposed on the front end of the waist member along a length direction, the lower portion of the front end of each of the two shoulder straps being slidably connected with the fixing member, a width between the two shoulder straps being adjusted by a slide of the front end of each of the two shoulder straps on the fixing member.

2. The baby carrier of claim 1, wherein the circular structure is slidably sleeved on the fixing member.

3. The baby carrier of claim 1, wherein the lower portion of the front end of the shoulder strap is rolled and stitched to form the circular structure.

4. The baby carrier of claim 1, wherein the fixing member comprises a sliding member and a connecting plate fixedly connected with the front end of the waist member, and the sliding member is slidably connected with the connecting plate.

5. The baby carrier of claim 4, wherein an upper end of the sliding member forms a through hole for the circular structure to pass through.

6. The baby carrier of claim 4, wherein a lower end of the sliding member is recessed to form a sliding groove, the connecting plate has a sliding rail matched with the sliding groove, and the sliding member is slidably connected with the connecting plate by a slide of the sliding groove on the sliding rail.

7. The baby carrier of claim 4, wherein the connecting plate has a positioning hole and a lower end of the sliding member has a positioning protrusion matched with the positioning hole.

8. The baby carrier of claim 1, wherein the fixing member is a webbing structure.

9. The baby carrier of claim 8, wherein a middle segment of the fixing member is fixedly connected with a middle segment of the front end of the waist member and two circular structures of the two shoulder straps are respectively located at opposite sides of the middle segment of the fixing member.

10. The baby carrier of claim 9, wherein the middle segment of the fixing member is located at an inner side of the middle segment of the waist member.

11. The baby carrier of claim 9, wherein opposite ends of the fixing member respectively pass through opposite ends of the waist member.

12. The baby carrier of claim 11, wherein the opposite ends of the fixing member respectively and slidably pass through the opposite ends of the waist member.

13. The baby carrier of claim 11, wherein a portion of the fixing member passing through the waist member is fixedly stitched.

14. The baby carrier of claim 11, wherein the opposite ends of the fixing member are detachably connected with each other by a first fastener in an engagement manner and a length of the first fastener is adjustable.

15. The baby carrier of claim 1, wherein the circular structure is detachably connected with the waist member.

16. The baby carrier of claim 15, wherein the circular structure is detachably connected with the waist member by one of Velcro, buckle and snap button.

17. The baby carrier of claim 1, wherein the two shoulder straps are arranged in parallel.

18. The baby carrier of claim 17, wherein the two shoulder straps are detachably connected with each other by a plug-in buckle in an engagement manner and a length of the plug-in buckle is adjustable.

19. The baby carrier of claim 1, wherein the two shoulder straps are arranged in a cross manner.

20. The baby carrier of claim 19, further comprising a shoulder strap fixing member, the two shoulder straps slidably passing through the shoulder strap fixing member in the cross manner, the two shoulder straps being arranged in the cross manner by the shoulder strap fixing member, a cross position between the two shoulder straps being adjusted by a slide of the shoulder strap fixing member.

21. The baby carrier of claim 20, wherein the shoulder strap fixing member has two channels crossing each other for the two shoulder straps to slidably pass through, and the two shoulder straps correspondingly pass through the two channels in the cross manner.

22. The baby carrier of claim 20, wherein the shoulder strap fixing member is a hollow structure, the shoulder strap fixing member has a plurality of ports penetrating through the hollow structure on two cross directions, and two of the ports opposite to each other allow the same shoulder strap to pass through.

23. The baby carrier of claim 22, wherein the shoulder strap fixing member is a diamond structure.

24. The baby carrier of claim 22, wherein the shoulder strap fixing member is a ring-shaped structure.

25. The baby carrier of claim 24, wherein a cross angle formed between the two shoulder straps at the ring-shaped structure is 90°.

26. The baby carrier of claim 1, wherein the upper portion of the support sheet and the upper portions of the front ends of the two shoulder straps are detachable structures.

27. The baby carrier of claim 26, wherein the upper portion of the front end of the shoulder strap is detachably connected with the upper portion of the support sheet by a second fastener in an engagement manner and a length of the second fastener is adjustable.

28. The baby carrier of claim 1, wherein the shoulder strap is a length-adjustable structure.

29. The baby carrier of claim 1, wherein the rear end of the shoulder strap is detachably connected with the middle portion of the support sheet by a third fastener in an engagement manner and a length of the third fastener is adjustable.

30. The baby carrier of claim 1, wherein the rear end of the shoulder strap is fixedly connected with the middle portion of the support sheet.

31. The baby carrier of claim 30, wherein the rear end of the shoulder strap is a webbing structure, the middle portion of the support sheet is connected with another webbing structure, the webbing structure of the rear end of the shoulder strap is fixedly connected with the another webbing structure of the middle portion of the support sheet by a buckle.

32. The baby carrier of claim 1, wherein the shoulder strap has a wing portion extending outward and the wing portion has an expanding position and a folding position with respect to the shoulder strap.

* * * * *